US007644582B2

(12) United States Patent
Yatsuzuka et al.

(10) Patent No.: US 7,644,582 B2
(45) Date of Patent: Jan. 12, 2010

(54) EXTERNAL COMBUSTION ENGINE

(75) Inventors: Shinichi Yatsuzuka, Nagoya (JP); Yasunori Niiyama, Kuwana (JP); Shuzo Oda, Kariya (JP); Katsuya Komaki, Kariya (JP)

(73) Assignee: Denso Corporation, Kariya (JP)

( * ) Notice: Subject to any disclaimer, the term of this patent is extended or adjusted under 35 U.S.C. 154(b) by 118 days.

(21) Appl. No.: 12/075,625

(22) Filed: Mar. 13, 2008

(65) Prior Publication Data

US 2008/0229747 A1 Sep. 25, 2008

(30) Foreign Application Priority Data

Mar. 19, 2007 (JP) ..... 2007-070267

(51) Int. Cl.
*F02G 1/04* (2006.01)
*F01K 23/06* (2006.01)
*F02C 5/00* (2006.01)

(52) U.S. Cl. ..... 60/531; 60/508; 60/670; 60/39.6

(58) Field of Classification Search ..... 60/39.6, 60/39.63, 39.64, 516–526, 531
See application file for complete search history.

(56) References Cited

U.S. PATENT DOCUMENTS 4,195,481 A * 4/1980 Gregory ..... 60/516
4,584,840 A * 4/1986 Baumann ..... 62/6
2005/0257524 A1 11/2005 Yatsuzuka et al.

FOREIGN PATENT DOCUMENTS

DE 10021747 A1 * 11/2001
JP 10-252557 9/1998
JP 10252556 A * 9/1998
JP 10252557 A * 9/1998
JP 10252558 A * 9/1998
JP 2005-330883 12/2005
JP 2005-330885 12/2005

OTHER PUBLICATIONS

Office action dated Dec. 24, 2008 in Japanese Application No. 2007-070267.

* cited by examiner

*Primary Examiner*—Thomas E Denion
*Assistant Examiner*—Christopher Jetton
(74) *Attorney, Agent, or Firm*—Harness, Dickey & Pierce, PLC

(57) ABSTRACT

An external combustion engine including a container 10 sealed with a working medium 14 in liquid phase adapted to flow, a multiplicity of evaporators 201 to 204 for heating and evaporating part of the liquid-phase working medium 14, a multiplicity of condensers 221 to 224 for cooling and condensing the working medium 14 evaporated in the evaporators 201 to 204, and an output unit 11 for outputting by converting the displacement of the liquid-phase portion of the working medium 14 into mechanical energy. The multiplicity of the evaporators 201 to 204 share a heat source from which heat is supplied thereto. The engine further includes an influent liquid amount regulation unit whereby the liquid-phase portion of the working medium 14 in a greater amount flows into the evaporators nearer the heat source upon displacement of the liquid-phase portion of the working medium 14 toward the multiplicity of the evaporators 201 to 204 from the output unit 11, while the influent liquid amount is smaller for the evaporators farther from the heat source. In this way, heat loss is reduced resulting in improved efficiency.

8 Claims, 7 Drawing Sheets

EXTERNAL COMBUSTION ENGINE

BACKGROUND OF THE INVENTION

1. Field of the Invention

This invention relates to an external combustion engine for displacing a liquid-phase portion of a working medium by evaporation and condensation of the working medium and outputting by converting the displacement of the liquid-phase portion of the working medium into mechanical energy.

2. Description of the Related Art

Japanese Unexamined Patent Publication No. 2005-330885 discloses a external combustion engine, in which a container having a working medium adapted to flow in a liquid phase is provided with at least an evaporator for heating and evaporating part of the working medium in a liquid phase and at least a condenser for cooling and condensing the working medium evaporated in the evaporator. In this configuration, the liquid-phase portion of the working medium is displaced by the evaporation and condensation thereof and this displacement of the liquid-phase portion of the working medium is converted into mechanical energy which is retrieved from an output unit.

In this technique, the portion of the container near the output unit is configured of a single collecting pipe, while the portion of the container formed with an evaporator and condenser is configured of a multiplicity of branch pipes thereby increasing the heat transmission area of the evaporator and condenser. As a result, the heating (evaporation performance) and cooling performance (condensation performance) of the working medium are improved for an improved output of the external combustion engine.

According to this technique, the portion of the multiplicity of the branch pipes formed with the evaporator is arranged in the flow of a high-temperature gas to heat the working medium with the high-temperature gas as a heat source.

Also, according to this technique, the multiplicity of the branch pipes are arranged both in the direction along the flow of the high-temperature gas and in the direction perpendicular to the direction of the high-temperature gas flow. In other words, the multiplicity of the branch pipes are arranged in a grid pattern to thereby prevent the multiplicity of the branch pipes from making the container bulky.

However, in the techniques described above, the high-temperature gas flowing from the upstream to the downstream side is deprived of heat by the evaporator of the multiplicity of the branch pipes and decreases in temperature. As a result, the more upstream the evaporator of the branching pipes arranged in the high-temperature gas is, the greater the heat exchange amount, and vice versa.

Consequently, the working medium, in the evaporator of the branching pipes upstream in the high-temperature gas flow is sufficiently heated and evaporated at the boiling point. However, the working medium in the evaporator of the branch pipes downstream in the high-temperature gas flow is not sufficiently heated and often fails to reach the boiling point.

In the branch pipes downstream in the high-temperature gas flow, the displacement amount of the liquid-phase portion of the working medium is decreased, resulting in a smaller output. Specifically, if the working medium fails to reach the boiling point after being heated, the corresponding heat loss deteriorates the efficiency of the external combustion engine. This problem of deteriorated efficiency due to the heat loss occurs also in the case where two as well as a multiplicity of branch pipes are provided in this engine.

In the case where one heat generating unit is arranged in the neighborhood of the container and where the evaporator is heated by the heat generated by the one heat generating unit, the working medium is heated sufficiently in the branch pipes in the neighborhood of the one heat generating unit, while the working medium cannot be sufficiently heated in the branch pipes far from the one heat generating unit, thereby posing a similar problem of efficiency deterioration due to heat loss.

SUMMARY OF THE INVENTION

In view of the above-mentioned points, the object of this invention is to reduce heat loss and improve efficiency.

In order to achieve the aforementioned object, according to a first aspect of the invention, there is provided an external combustion engine comprising:

a container (10) containing a working medium (14) adapted to flow in liquid phase, including one collecting pipe (15) and a multiplicity of branch pipes (161 to 164) branching from the collecting pipe (15);

a multiplicity of evaporators (201 to 204) communicating with the end of the multiplicity of the branch pipes (161 to 164) far from the collecting pipe (15) for heating and evaporating part of the working medium (14) in liquid phase;

a multiplicity of condensers (221 to 224) formed in at least a part of the multiplicity of the branch pipes (161 to 164) for cooling and condensing the working medium (14) evaporated in the evaporators (201 to 204); and an output unit (11) communicating with the end of the collecting pipe (15) far from the multiplicity of the branch pipes (161 to 164) for converting the displacement of the liquid-phase portion of the working medium (14) into mechanical energy and outputting the energy;

wherein the multiplicity of the evaporators (201 to 204) are supplied with heat from a common heat source; and wherein a first process for displacing the liquid-phase portion of the working medium (14) toward the output unit (11) by evaporating the working medium (14) in the multiplicity of the evaporators (201 to 204) alternates with a second process for displacing the liquid-phase portion of the working medium (14) toward the multiplicity of the evaporators (201 to 204) by condensing the working medium evaporated in the first process in the multiplicity of the condensers (221 to 224);

the external combustion engine further comprising an influent liquid amount regulation means wherein upon displacement of the liquid-phase portion of the working medium (14) from the output unit (11) toward the multiplicity of the evaporators (201 to 204) in the second process, the influent liquid amount defined as the amount of the liquid-phase portion of the working medium (14) flowing into any one of the multiplicity of the evaporators (201 to 204) is so adjusted that the influent liquid amount is larger for any of the multiplicity of the evaporators (201 to 204) nearer to the heat source, and smaller for any of the multiplicity of the evaporators (201 to 204) farther from the heat source.

In this configuration, a greater amount of the liquid-phase portion of the working medium (14) is supplied to the evaporators closer to the heat source, i.e. evaporators capable of exchanging larger amount of heat, while a smaller amount of the liquid-phase portion of the working medium (14) is supplied to the evaporators farther from the heat source, i.e. the evaporators are capable of exchanging smaller amount of heat.

As a result, the working medium (14) can be positively evaporated in any of the multiplicity of the evaporators (201 to 204), and therefore, heat loss is reduced for improved efficiency.

According to a second aspect of the invention, there is provided an external combustion engine, wherein the multiplicity of the evaporators (201 to 204) include a multiplicity of inlets (271 to 274) from which the liquid-phase portion of the working medium (14) flows therein, a multiplicity of wall surfaces (331 to 334) in opposed relation to the inlets (271 to 274) at predetermined intervals, and a multiplicity of main evaporators (341 to 344) extending from a space between the inlets (271 to 274) and the opposed wall surfaces (331 to 334) in the direction perpendicular to the direction of the opening of the inlets (271 to 274), and wherein the influent liquid amount regulation means is so configures that the area of the opposed wall surfaces is larger for the evaporators closer to the heat source, and the area of the opposed wall surfaces is smaller for the evaporators farther from the heat source.

In this configuration, the liquid-phase portion of the working medium (14) that has flowed into the evaporators (201 to 204) from the inlets (271 to 274) changes the direction of displacement at a right angle by bombarding the opposed wall surfaces (331 to 334) and advances into the main evaporators (341 to 344) of the evaporators (201 to 204).

The evaporators closer to the heat source have a larger area of the opposed wall surfaces, and vice versa. Therefore, the liquid-phase portion of the working medium (14) is more liable to bombard the opposed wall surfaces (331 to 334) of the evaporators nearer to the heat source and thus more liable to advance into the main evaporators (341 to 344). On the other hand, the bombardment of the opposed wall surfaces (331 to 334) of the evaporators farther from the heat source by the liquid-phase portion of the working medium (14) is suppressed more, thereby suppressing the advance of the working medium (14) into the main evaporators (341 to 344).

As a result, the closer the evaporators are the heat source, the greater the amount of the influent liquid, and vice versa. Thus, the influent liquid amount regulation means can be implemented with a simple configuration.

The wording "extending in the direction perpendicular to the direction of the opening of the inlets (271 to 274)" is not strictly limited to the extension in the perpendicular direction but should be understood to include the extension in the direction somewhat diagonal to the perpendicular direction.

According to a third aspect of the invention, there is provided an external combustion engine comprising a vapor pool (29) for storing the vapor of the working medium (14) generated in the multiplicity of the evaporators (201 to 204), wherein a multiplicity of vapor paths (311 to 314) communicating with the vapor pool (29) and having the vapor flowing therein are open to the opposed wall surfaces (331 to 334) of the multiplicity of the evaporators (201 to 204), and wherein the closer the evaporators to the heat source, the smaller the open area of the vapor paths, and vice versa.

According to a fourth aspect of the invention, there is provided an external combustion engine, wherein the closer the evaporators to the heat source, the larger the area of the inlets, and vice versa.

According to a fifth aspect of the invention, there is provided an external combustion engine, wherein the influent liquid amount regulation means is so configured that the branch pipes communicating with the evaporators closer to the heat source branch out from the portion of the collecting pipe (15) closer to the output unit (11), and vice versa.

In this configuration, the closer the evaporators to the heat source, the longer the working medium path leading to the evaporators is and the smaller the flow path resistance, and vice versa.

As a result, the closer the evaporators to the heat source, the greater the influent liquid amount, and vice versa. Thus, the influent liquid amount regulation means can be realized with a simple configuration.

According to a sixth aspect of the invention, there is provided an external combustion engine, wherein a multiplicity of chokes (351 to 353) for increasing the flow path resistance are formed between the portions of the collecting pipe (15) from which the multiplicity of the branch pipes (161 to 164) are extended.

In this configuration, the flow resistance of the working medium path leading to each evaporator from the output unit (11) can be appropriately set by the chokes (351 to 353), and therefore, the liquid amount flowing into each evaporator can be more properly adjusted. As a result, heat loss is reduced and efficiency is improved.

According to a seventh aspect of the invention, there is provided an external combustion engine, wherein the heat source is a high-temperature fluid, wherein the evaporators near the heat source are arranged on the upstream side of the multiplicity of the evaporators (201 to 204) in the high-temperature fluid, and wherein the evaporators far from the heat source are arranged on the downstream side of the multiplicity of the evaporators (201 to 204) in the high-temperature fluid.

In this configuration, the aforementioned effects of the invention can be exhibited effectively for the external combustion engine using the high-temperature fluid as a heat source shared by the multiplicity of the evaporators (201 to 204).

According to an eighth aspect of the invention, there is provided an external combustion engine, comprising:

a container (10) containing a working medium (14) adapted to flow in liquid phase, including one collecting pipe (15) and a plurality of branch pipes (161 to 164) branching from the collecting pipe (15);

a plurality of evaporators (201 to 204) communicating with the end of the plurality of the branch pipes (161 to 164) far from the collecting pipe (15) for heating and evaporating part of the working medium (14) in liquid phase;

a plurality of condensers (221 to 224) formed in at least a part of the plurality of the branch pipes (161 to 164) for cooling and condensing the working medium (14) evaporated in the evaporators (201 to 204); and an output unit (11) communicating with the end of the collecting pipe (15) far from the plurality of the branch pipes (161 to 164) for converting the displacement of the liquid-phase portion of the working medium (14) into mechanical energy and outputting the energy;

wherein the plurality of the evaporators (201 to 204) are supplied with heat from a common heat source; and wherein a first process for displacing the liquid-phase portion of the working medium (14) toward the output unit (11) by evaporating the working medium (14) in the plurality of the evaporators (201 to 204) alternates with a second process for displacing the liquid-phase portion of the working medium (14) toward the plurality of the evaporators (201 to 204) by condensing the working medium evaporated in the first process in the plurality of the condensers (221 to 224);

the external combustion engine further comprising an influent liquid amount regulation means wherein the influent liquid amount, defined as the amount of the liquid-phase portion of the working medium (14) flowing into any one of the plurality of the evaporators (201 to 204) upon displacement of the liquid-phase portion of the working medium (14) from the output unit (11) toward the plurality of the evaporators (201 to 204) in the second process, is adjusted so that the influent liquid amount into any of the plurality of the evaporators (201 to 204) closer to the heat source is greater than the influent liquid amount in the evaporators far from the heat source.

In this configuration, the working medium (14) can be positively evaporated in both the evaporators close to the heat source and the evaporators far from the heat source. Therefore, heat loss can be reduced and efficiency improved.

The reference numerals inserted in the parentheses following the names of the respective means described in this column and the appended claims represent the specific means included in the embodiments described below.

The present invention may be more fully understood from the description of preferred embodiments of the invention, as set forth below, together with the accompanying drawings.

DESCRIPTION OF THE PREFERRED EMBODIMENTS

First Embodiment

The first embodiment of the invention is explained below with reference to FIGS. 1 to 4. This embodiment represents an application of the external combustion engine according to the invention to a power generating system. The external combustion engine according to this invention is known as a liquid piston-type steam engine.

Figure 1:
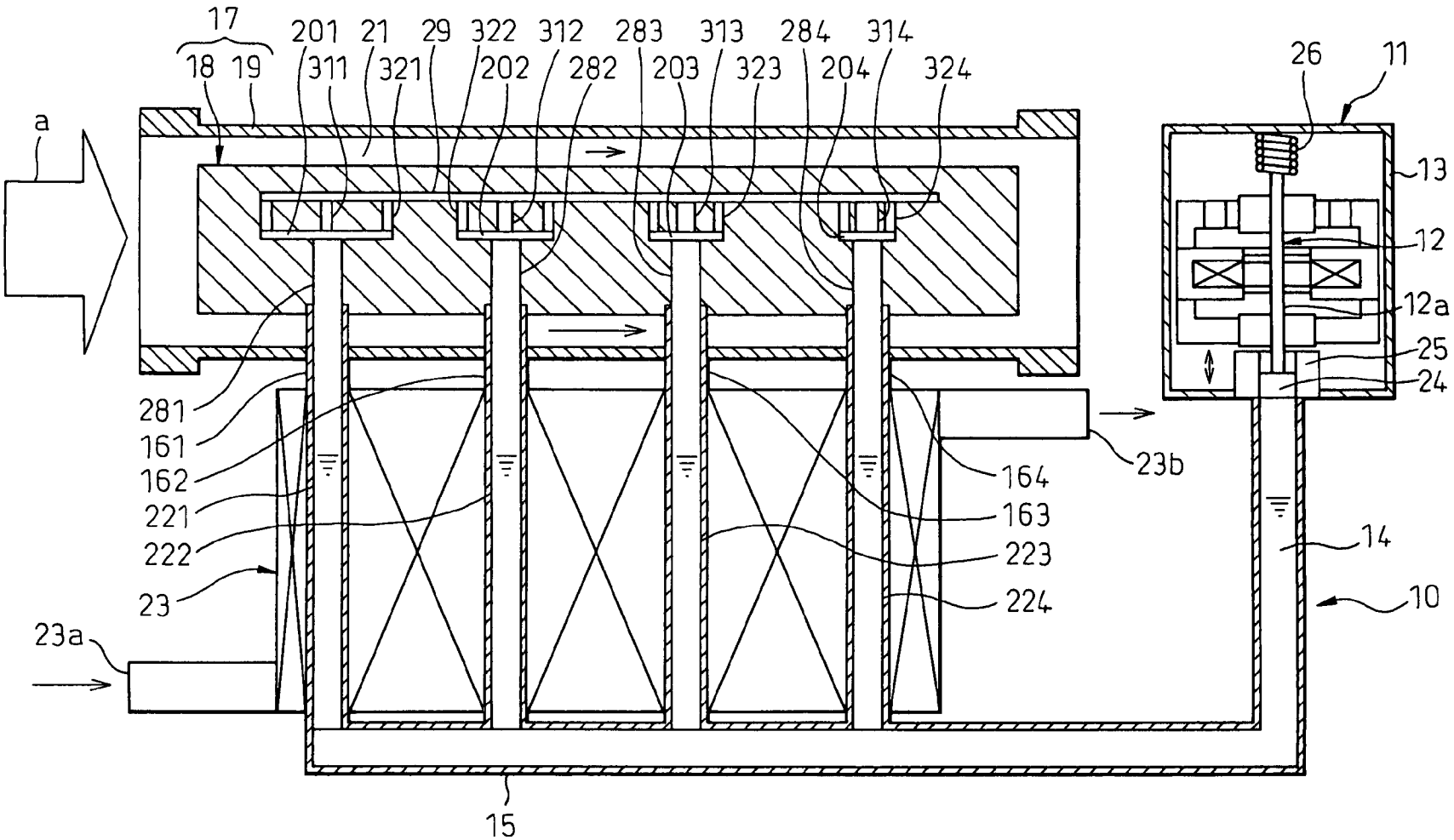
FIG. 1 is a diagram showing a general configuration of the power generating system according to a first embodiment of the invention.

FIG. 1 is a diagram showing a general configuration of the external combustion engine according to this embodiment. In FIG. 1, the vertical arrow indicates the upward and downward directions of the external combustion engine installed. The external combustion engine according to this embodiment includes a container 10 and a generator 11 making up an output unit. The generator 11 includes a movable member 12 having a permanent magnet embedded therein, and the movable member 12 is accommodated in a casing 13 to generate the electromotive force by the vibratory displacement of the movable member 12.

The container 10 is a pressure vessel containing a working medium (water in this embodiment) 14 adapted to flow in liquid phase and includes one collecting pipe 15 connected to the generator 11 and four parallel branch pipes 161 to 164 branching from the collecting pipe 15. The four branch pipes 161 to 164 correspond to a multiplicity of branch pipes and a plurality of branch pipes according to this invention. In this embodiment, the collecting pipe 15 and the branch pipes 161 to 164 are formed of stainless steel.

The collecting pipe 15 is extended downward from the generator 11 and formed in the shape of L by being bent in the horizontal direction at the intermediate portion thereof. The four branch pipes 161 to 164 each extend upward from the horizontal extension of the collecting pipe 15. Also, the four branch pipes 161 to 164 are arranged in the horizontal direction (lateral direction in FIG. 1). According to this embodiment, both the collecting pipe 15 and the branch pipes 161 to 164 are formed in the shape of a cylinder.

The upper ends of the four branch pipes 161 to 164 are connected to each other by a heat exchanger 17 for exchanging heat between the working medium 14 and the high-temperature gas. The heat exchanger 17 is configured of a parallelopipedal block member 18 and a case 19 for accommodating the block member 18.

The block member 18 makes up a part of the container 10 and formed of copper or aluminum high in heat conductivity. The longitudinal direction of the block member 18 coincides with the direction in which the four branch pipes 161 to 164 are arranged (lateral direction in FIG. 1).

Though not shown, the block member 18 is consist of a plurality of division members for the reason of the forming process. At first, these division members are formed respectively. After that, the block member 18 is assembled by integrally fastening the plurality of the division members with fastening means such as screws.

The block member 18 has formed therein four hollow portions 201 to 204 corresponding to the four branch pipes 161 to 164. The four hollow portions 201 to 204 are discal spaces formed coaxially with the branch pipes 161 to 164 and make up evaporators for heating and evaporating a part of the working medium 14 in liquid phase. The four hollow portions (evaporators) 201 to 204, like the four branch pipes 161 to 164, are arranged horizontally (laterally in FIG. 1), and correspond to the multiplicity of the evaporators and the plurality of the evaporators according to the invention as described in detail later.

The case 19 extends in longitudinal direction (horizontally in FIG. 1) of the block member 18, and has each end thereof connected to a gas pipe (not shown) with a high-temperature gas (high-temperature fluid) flowing therein as a heat source. A space 21 in which the high-temperature gas flows is formed between the outer surface of the block member 18 and the inner wall surface of the case 19.

According to this embodiment, as indicated by arrow a in FIG. 1, the high-temperature gas flows toward the generator 11 (rightward in FIG. 1) from the side far from the generator 11 (the left side in FIG. 1). The space 21 in the case 19 has arranged therein heat transmission fins for increasing the heat transmission area between the block member 18 and the high-temperature gas.

The internal spaces at the intermediate parts along the length of the branch pipes 161 to 164 (in the vertical direction in FIG. 1) make up condensers 221 to 224 for cooling and condensing the working medium 14 evaporated in the evaporators 201 to 204. A cooler 23 for circulating the cooling water is arranged in contact with the outer peripheral surface of the intermediate parts of the branch pipes 161 to 164 in a manner capable of heat transmission.

With the circulation of the cooling water in the cooler 23, the intermediate parts of the branch pipes 161 to 164 are cooled and the working medium 14 is cooled by the condensers 221 to 224. The cooling water inlet 23*a* and the cooling water outlet 23*b* of the cooler 23 are connected to the cooling water circuit in which a radiator (not shown) is arranged. As a result, the heat of which the cooling water has deprived the vapor of the working medium 14 is released into the atmosphere by the radiator.

The intermediate parts of the branch pipes 161 to 164, i.e. the portions of the branch pipes 161 to 164 in contact with the cooler 23 may be formed of copper or aluminum high in heat conductivity.

In the casing 13 of the generator 11, on the other hand, a piston 24 adapted to be displaced under the pressure from the liquid-phase portion of the working medium 14 is slidably arranged on a cylinder 25. The piston 24 is connected to a shaft 12*a* of the movable member 12. A coil spring 26 for generating the elasticity to push back the movable member 12 is arranged on the side of the movable member 12 far from the piston 24.

Figure 2:
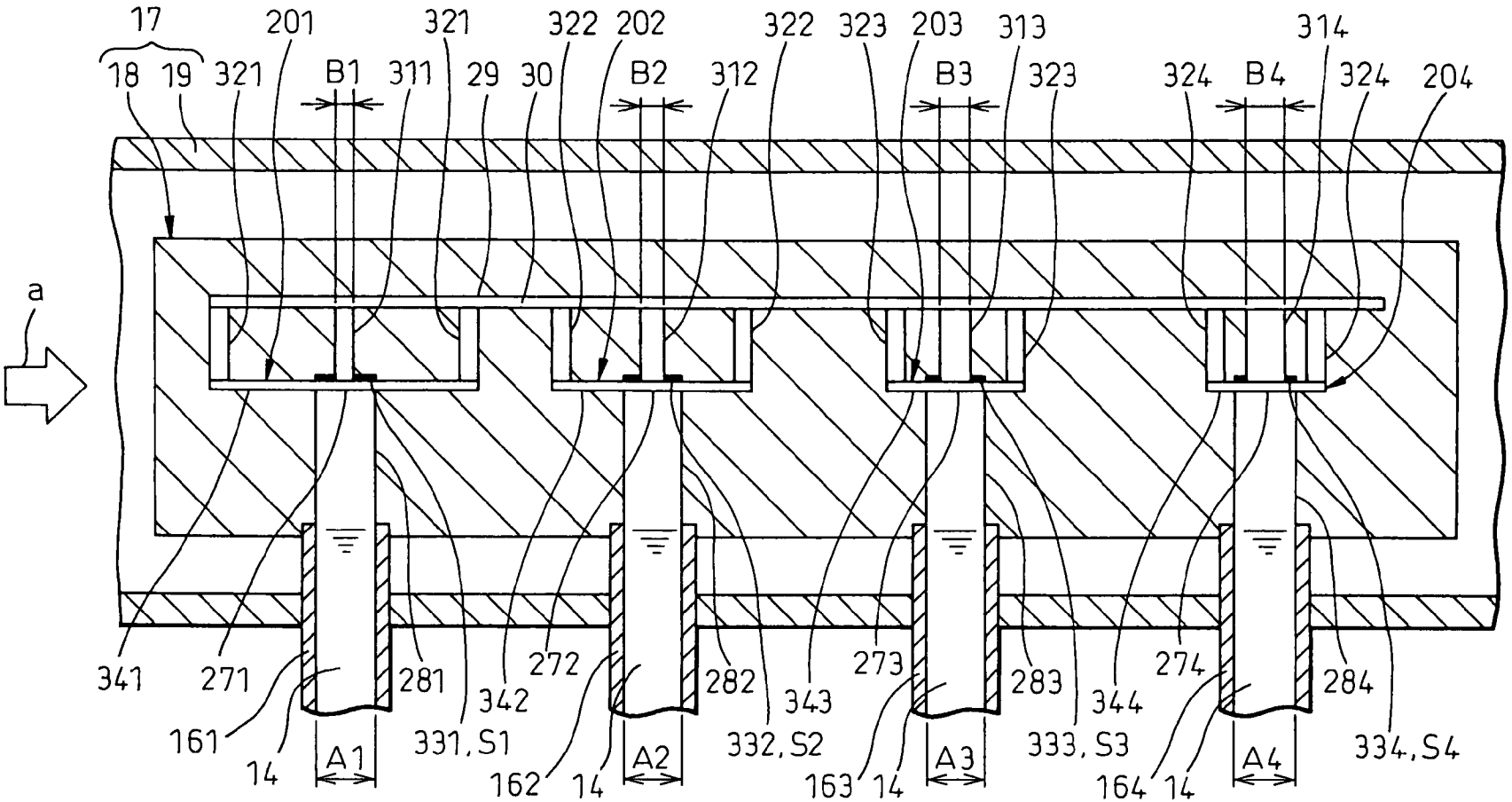
FIG. 2 is an enlarged sectional view of the heat exchanger according to the first embodiment.

Next, the four evaporators 201 to 204 are explained in detail with reference to FIG. 2. As explained above, the four evaporators 201 to 204 are discal spaces formed coaxially with the branch pipes 161 to 164, respectively. According to this embodiment, each disk surface of the evaporators 201 to 204 are perpendicular to axial direction of the branch pipes 161 to 164, however, may be tilted at some angle to the axis of the branch pipes 161 to 164.

The diameter of the evaporators 201 to 204 is larger than the inner diameter of the branch pipes 161 to 164. According to this embodiment, the diameters of the evaporators located more upstream (leftward in FIG. 2) in the high-temperature gas (hereinafter referred to as the upstream-side evaporators) are larger. The diameters of the evaporators located more downstream (rightward in FIG. 2) in the high-temperature gas (hereinafter referred to as the downstream-side evaporator) are small. Nevertheless, the evaporators 201 to 204 may have the same diameter. Also, according to this embodiment, the branch pipes 161 to 164 have the same inner diameter.

A plurality of inlets 271 to 274 through which the working medium 14 in liquid phase flows in are opened to the lower surfaces of the evaporators 201 to 204 (the surfaces nearer to the branch pipes 161 to 164), and from these inlets 271 to 274, a plurality of working medium paths 281 to 284 extend downward (toward the branch pipes 161 to 164).

The working medium paths 281 to 284 are formed of cylindrical holes in the block member 18 and arranged coaxially with the branch pipes 161 to 164, respectively. Through the working medium paths 281 to 284, the evaporators 201 to 204 and the upper ends of the branch pipes 161 to 164 communicate with each other. According to this embodiment, the diameters A1 to A4 of the inlets 271 to 274 are equal to each other. Also, the diameters A1 to A4 of the inlets 271 to 274 and the diameters of the working medium paths 281 to 284 are equal to the inner diameters of the branch pipes 161 to 164.

According to this embodiment, the thickness (vertical sizes in FIG. 2) of the evaporators 201 to 204 are equal to each other. Also, the thickness of the evaporators 201 to 204 are very small compared with the diameters of the working medium paths 281 to 284. More specifically, the thickness of the evaporators 201 to 204 are set to not larger than the thermal penetration depth σ so as to evaporate the working medium 14 satisfactorily in the evaporators 201 to 204.

The thermal penetration depth σ is an index of the extent to which the periodic temperature change, if any, of the working medium 14 in liquid phase in the evaporators 201 to 204 is transmitted. Specifically, the thermal penetration depth σ is an index for determining the distribution of the entropy change along the thickness (vertical direction in FIG. 1) of the evaporators 201 to 204 with the thermal diffusivity a (m/s) and the angular frequency ω (rad/s), and expressed by Equation (1) below.

$$\sigma=\sqrt{(2\cdot a/\omega)} \tag{1}$$

wherein the thermal diffusivity a is obtained by dividing the heat conductivity of the working medium 14 in liquid phase by the specific heat and the density of the working medium 14 in liquid phase.

Only one vapor pool 29 for storing the vapor of the working medium 14 generated in the evaporators 201 to 204 is formed above the evaporators 201 to 204 (the side far from the branch pipes 161 to 164) in the block member 18.

The vapor pool 29 extends in parallel to the direction of arrangement (lateral direction in FIG. 1) of and at a predetermined distance from the evaporators 201 to 204. Also, the vapor pool 29 contains a predetermined volume of a gas 30 as an additional medium. A medium for maintaining the gas phase under the operating conditions of the external combustion engine is selected as the additional medium. Therefore, the air may be selected as gas 30 because it is easier to handle, the pure vapor of the working medium 14 may also be adopted.

The vapor pool 29 communicates with the central portion of the evaporators 201 to 204 through the central vapor paths 311 to 314, and further, with the outer peripheral portion of the evaporators 201 to 204 through the outer peripheral vapor paths 321 to 324. Incidentally, the central vapor paths 311 to 314 correspond to the vapor paths according to this invention.

The central vapor paths 311 to 314 are arranged at the central portion of each of the evaporators 201 to 204. A plurality of the outer peripheral vapor paths 321 to 324, on the other hand, are arranged on each outer peripheral portion of the evaporators 201 to 204. According to this embodiment, all of the vapor paths 311 to 314, 321 to 324 are formed as cylindrical holes.

Each diameter of the vapor paths 311 to 314, 321 to 324 is very large as compared with the sizes along the thickness of the evaporators 201 to 204. The working medium 14 in liquid phase, therefore, which may flow into the vapor paths 311 to 314, 321 to 324 is hardly evaporated.

The central vapor paths 311 to 314 are arranged coaxially with the working medium paths 281 to 284, and the diameters B1 to B4 of the central vapor paths 311 to 314 are set to less than the diameters A1 to A4 of the inlets 271 to 274, respectively.

The inner wall surfaces of the evaporators 201 to 204 which are located opposed to the inlets 271 to 274 on the outer periphery of the central vapor paths 311 to 314 make up bombardment surfaces 331 to 334 bombarded by the liquid-phase portion of the working medium 14. The bombardment surfaces 331 to 334 correspond to the opposed wall surfaces according to the invention. In FIG. 2, the range in which the bombardment surfaces 331 to 334 are formed is designated by thick solid line (as in FIGS. 3A, 3B and 5 described later).

The outer peripheral portions of the bombardment surfaces 331 to 334 and the inlets 271 to 274 included in the evaporators 201 to 204 are formed with annular main evaporators 341 to 344.

The areas S1 to S4 of the bombardment surfaces 331 to 334 are determined as the difference between the areas of the inlets 271 to 274 and the opening areas of the central vapor paths 311 to 314 of the evaporators 201 to 204, respectively.

According to this embodiment, the diameters B1 to B4 of the central vapor paths 311 to 314 are progressively smaller toward the upstream evaporators and progressively larger toward the downstream evaporators (B<B2<B3<B4). As described above, on the other hand, the diameters A1 to A4 of the inlets 271 to 274 are equal to each other. The areas S1 to S4 of the bombardment surfaces 331 to 334, therefore, are progressively larger toward the upstream evaporators and progressively smaller toward the downstream evaporators (S1>S2>S3>S4).

According to this embodiment, the volume of the working medium 14 stored in the container 10 is set in such a manner that the liquid-phase portion of the working medium 14 is prevented from advancing into the vapor pool 29 even in the case where the vapor volume of the working medium 14 is reduced to a minimum and the liquid level of the working medium 14 rises to a maximum.

The vapor pool 29, like the evaporators 201 to 204, is formed in the block member 18, and therefore, the gas 30 in the vapor pool 29 is heated to about the same temperature as the vapor of the working medium 14. As a result, the vapor of the working medium 14 that has advanced into the vapor pool 29 is prevented from being cooled and condensed in the vapor pool 29.

Next, the operation with the configuration described above will be briefly explained. First, when the working medium (water) 14 in the evaporators 201 to 204 is heated and evaporated (gasified), the high-temperature high-pressure vapor of the working medium 14 is accumulated in the vapor pool 29 and the evaporators 201 to 204, and the liquid level of the working medium 14 in the branch pipes 161 to 164 is pushed down. Then, the liquid-phase portion of the working medium 14 is pushed out toward the generator 11 from the evaporators 201 to 204, and the piston 24 of the generator 11 is pushed up. In the process, the coil spring 26 is compressed and elastically deformed (first process).

Then, the liquid level of the working medium 14 in the branch pipes 161 to 164 moves down to the condensers 221 to 224, so that the vapor of the working medium 14 advances into the condensers 221 to 224 and is cooled and condensed (liquefied) by the condensers 221 to 224. As a result, the force to push down the liquid level of the working medium 14 and to push up the piston 24 is lost. Thus, the piston 24 of the generator 11 that has been pushed up is moved down by the elastic restitutive force of the coil spring 26. Then, the liquid-phase portion of the working medium 14 is pushed back toward the evaporators 201 to 204 from the generator 11 and the liquid level of the working medium 14 rises to the evaporators 201 to 204 (second process).

By repeating this operation, the liquid-phase portion of the working medium 14 in the container 10 is periodically displaced (in what is called the self-excited vibration) so that the movable member 12 of the generator 11 is periodically moved up and down.

Specifically, the alternate and repetitive evaporation and condensation of the working medium 14 displaces the liquid-phase portion of the working medium 14 like the piston, and thus, this configuration can convert the displacement of the liquid-phase portion of the working medium 14 into mechanical energy and output the energy. For this reason, the external combustion engine according to this embodiment is referred to also as the liquid piston-type vapor engine.

According to this embodiment, the evaporators 201 to 204 and the condensers 221 to 224 are divided into four parts, respectively. As compared with the case in which only one evaporator and only one condenser are provided, therefore, the heat transmission areas of the evaporators 201 to 204 and the condensers 221 to 224 can be increased. As a result, the heating performance and the cooling performance of the working medium 14 are improved for an improved output of the external combustion engine.

Figure 3B:
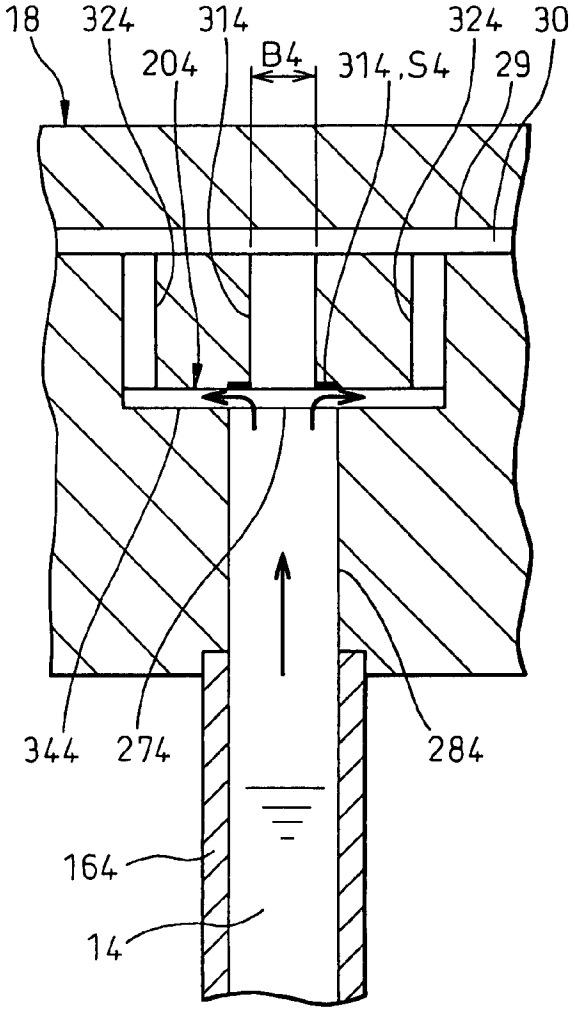
FIGS. 3A and 3B are sectional views for explaining the behavior of the working medium in the evaporators according to the first embodiment.
Figure 3A:
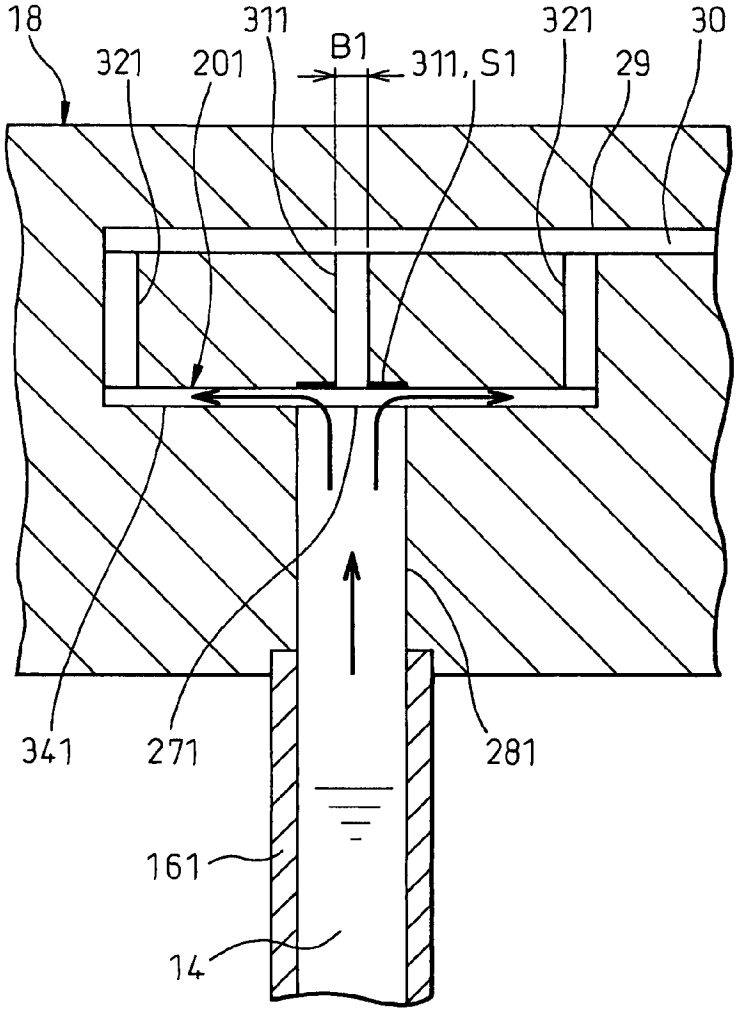

Next, the behavior of the working medium 14 in the evaporators 201 to 204 will be explained with reference to FIGS. 3A, 3B and 4. FIG. 3A shows the most upstream evaporator 201 in the high-temperature gas, and FIG. 3B the most downstream evaporator 204 in the high-temperature gas.

As the result of the rise of the liquid level of the working medium 14 with the vapor of the working medium 14 cooled and condensed in the condensers 221 to 224 in the second process, the liquid-phase portion of the working medium 14 advances into the central part of the evaporators 201 to 204 from the inlets 271 to 274. The liquid-phase portion of the working medium 14, after bombarding the bombardment surfaces 331 to 334 of the evaporators 201 to 204, changes the direction of displacement to the horizontal direction and advances into the main evaporators 341 to 344 on the outer periphery of the bombardment surfaces 331 to 334.

The liquid-phase portion of the working medium 14 that has bombarded the bombardment surfaces 331 to 334 of the evaporators 201 to 204 is agitated and generates a turbulent flow. As a result, the thermal boundary layer formed in the evaporators 201 to 204 is destroyed, and therefore, the heat transfer rate to the working medium 14 in the evaporators 201 to 204 is improved.

According to this embodiment, the block member 18 is heated by the high-temperature gas flowing in parallel to the length of the block member 18. The high-temperature gas flowing downstream is deprived of heat by the block member 18 progressively downstream.

Figure 4:
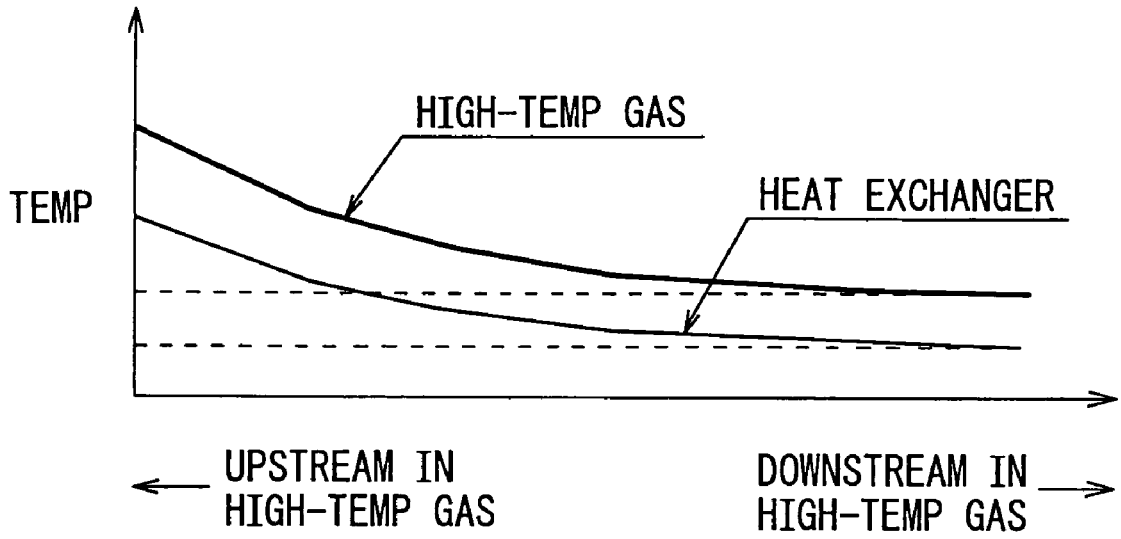
FIG. 4 is a graph showing the temperature distribution of the heat exchanger according to the first embodiment.

As indicated by the thick solid line in FIG. 4, therefore, the high-temperature gas decreases in temperature progressively downstream. At the same time, the temperature of the heat exchanger 17 or, more specifically, the temperature of the block member 18 also decreases with the downward flow of the high-temperature gas, as indicated by the thin solid line in FIG. 4. As a result, the evaporators located more upstream become larger in heat exchange amount, and the evaporators located more downstream become smaller in heat exchange amount. In the downstream evaporators, therefore, the working medium 14 often fails to reach the boiling point. As a result, the heat loss is generated, and the efficiency of the external combustion engine is deteriorated.

In view of this, according to this embodiment, the efficiency of the external combustion engine is improved by reducing the heat loss in the manner described below. Specifically, the areas S1 to S4 of the bombardment surfaces 331 to 334 are increased more for the evaporators located more upstream, and decreased more for the evaporators located more downstream (S1>S2>S3>S4). As shown in FIG. 3A, therefore, the liquid-phase portion of the working medium 14 more easily bombard the bombardment surfaces of the evaporators located more upstream, while the liquid-phase portion of the working medium 14 is less likely to bombard the bombard surfaces of the evaporators located more downstream.

Thus, in the evaporators located more upstream, the liquid-phase portion of the working medium 14 more easily changes the direction of displacement to the horizontal direction and advances into the main evaporators, while in the evaporators located more downstream, on the other hand, the direction change of the liquid-phase portion of the working medium 14 is suppressed more and so is the advance into the main evaporators.

As a result, the influent liquid amount of the working medium 14 is greater for the evaporators located upstream and having a larger heat exchange amount, and vice versa.

Consequently, the working medium 14 can be positively evaporated in all of the evaporators 201 to 204. Thus, the heat loss is reduced for an improved efficiency of the external combustion engine.

As understood from the foregoing description, this embodiment includes an influent liquid amount regulation means which increases the influent liquid amount of the working medium 14 more for the evaporators located more upstream and decrease the influent liquid amount of the working medium 14 more for the evaporators located more downstream by increasing the areas S1 to S4 of the bombardment surfaces 331 to 334 more for the evaporators located more downstream, and vice versa.

If the evaporators 201 to 204 and the vapor pool 29 communicate with each other only through the outer peripheral vapor paths 321 to 324, i.e. the central vapor paths 311 to 314 are lacking, in view of the fact that the outer peripheral vapor paths 321 to 324 are arranged on the outer periphery of the evaporators 201 to 204, the vapor of the working medium 14 generated in the neighborhood of the bombardment surfaces 331 to 334 of the evaporators 201 to 204 cannot be stored in the vapor pool 29 without passing from the central part to the outer periphery of the main evaporators 341 to 344. In other words, the vapor of the working medium 14 generated in the neighborhood of the bombardment surfaces 331 to 334 cannot be led smoothly to the vapor pool 29.

As a result, the vapor of the working medium 14, when passing through the main evaporators 341 to 344, forms bubbles by mixing with the liquid-phase portion of the working medium 14 in the main evaporators 341 to 344, and therefore, is cooled and liquefied by the liquid-phase portion of the working medium 14. Thus, the corresponding heat loss occurs and the efficiency of the external combustion engine is deteriorated.

In view of this, according to this embodiment, the evaporators 201 to 204 and the vapor pool 29 are rendered to communicate with each other not only through the outer peripheral paths 321 to 324 but also through the central vapor paths 311 to 314. Thus, the vapor of the working medium 14 generated in the neighborhood of the bombardment surfaces 331 to 334 can be quickly released to the vapor pool 29 through the central vapor paths 311 to 314.

As a result, the vapor of the working medium 14 is prevented from forming bubbles by mixing with the liquid-phase portion of the working medium 14, and therefore, the heat loss is reduced for an improved efficiency of the external combustion engine.

Also, according to this embodiment, the four evaporators 201 to 104 communicate with each other through the central vapor paths 311 to 314, the outer peripheral vapor paths 321 to 324 and the vapor pool 29. Even in the case where the working medium 14 is evaporated at different timing between the four evaporators 201 to 204, therefore, the internal pressure of the four evaporators 201 to 204 can be kept at the same level, and so can the internal pressure of the four branch pipes 161 to 164. Thus, the pressure difference is not caused among the four branch pipes 161 to 164.

In the case where the working medium 14 is evaporated at different timing among the four evaporators 201 to 204, part of the liquid-phase portion of the working medium 14 is prevented from being displaced toward the branch pipes slower in evaporation timing from the branch pipes faster in evaporation timing. Thus, the efficiency of the external combustion engine is prevented from being reduced.

Second Embodiment

Figure 5:
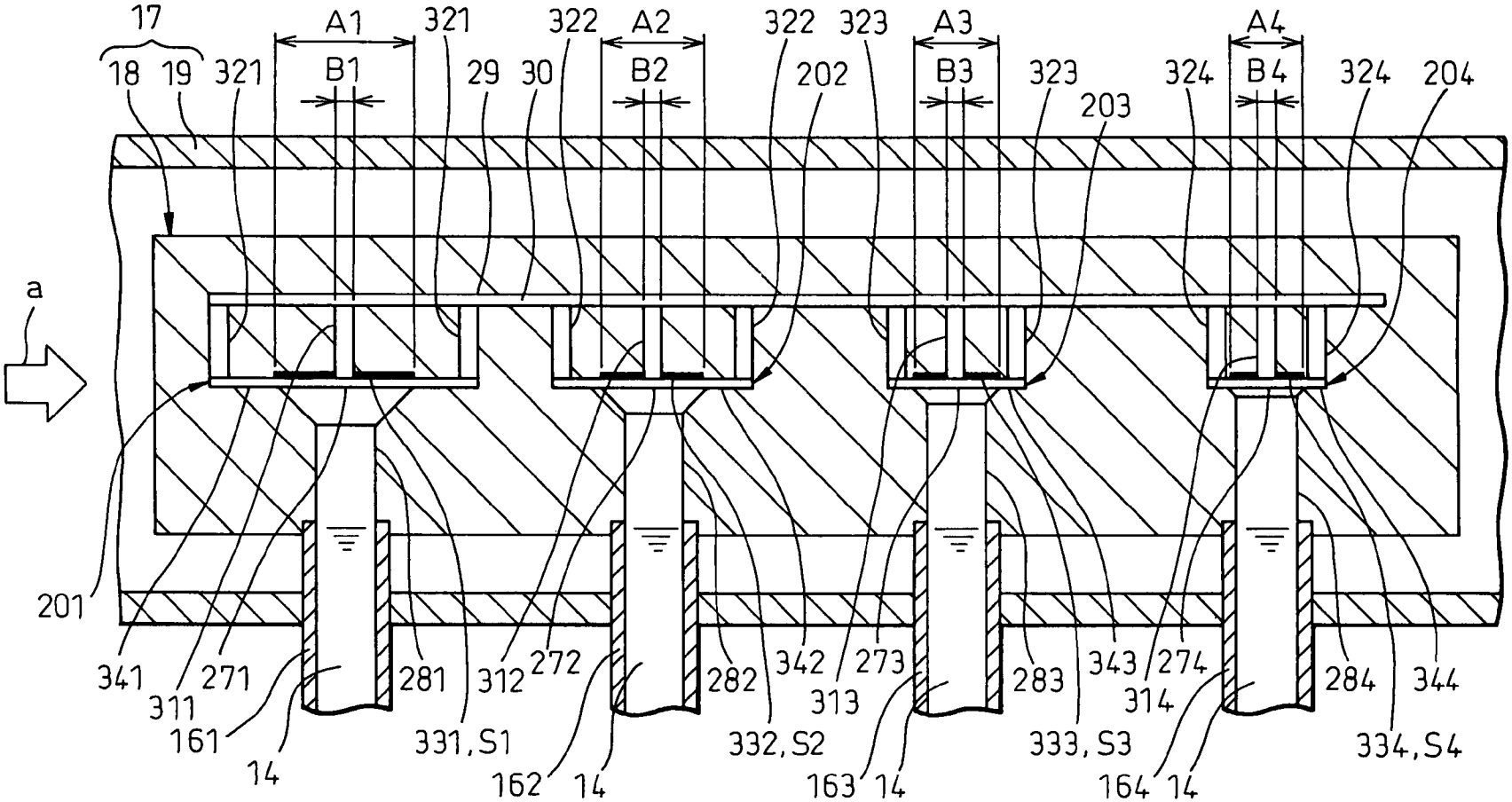
FIG. 5 is a sectional view showing the essential parts of the power generating system according to a second embodiment of the invention.

According to the first embodiment described above, the diameters B1 to B4 of the central vapor paths 311 to 314 are progressively reduced for the evaporators located more upstream, and vice versa. According to the second embodiment, on the other hand, as shown in FIG. 5, the diameters A1 to A4 of the inlets 271 to 274 of the evaporators 201 to 204 are increased progressively for the evaporators located more upstream, and vice versa (A1>A2>A3>A4).

According to this embodiment, while the diameters A1 to A4 of the inlets 271 to 274 of the evaporators 201 to 204 are increased progressively for the evaporators located more upstream, and vice versa, the ends of the working medium paths 281 to 284 nearer the evaporators 201 to 204 are formed with tapered portions having different enlarged diameters at the same time. Also, according to this embodiment, the diameters B1 to B4 of the central vapor paths 311 to 314 are made equal to each other.

As a result, the areas S1 to S4 of the bombardment surfaces 331 to 334 are increased progressively for the evaporators located more upstream, and vice versa (S1>S2>S3>S4), and similar effects to the first embodiment can be achieved.

Third Embodiment

According to the first and second embodiments described above, the influent liquid amount regulation means is configured to increase the influent liquid amount of the working medium 14 more for the progressively upstream evaporators by increasing the areas S1 to S4 of the bombardment surfaces 331 to 334 more for the progressively upstream evaporators. According to the third embodiment, on the other hand, the influent liquid regulation means is configured in such a manner that the branch pipes communicating with the evaporators located more upstream are rendered to branch from the portion of the collecting pipe 15 nearer the generator 11 while the branch pipes communicating with the evaporators located more downstream are rendered to branch from the portion of the collecting pipe 15 farther from the generator 11. In this way, similar effects to the first and second embodiments are produced.

Figure 6:
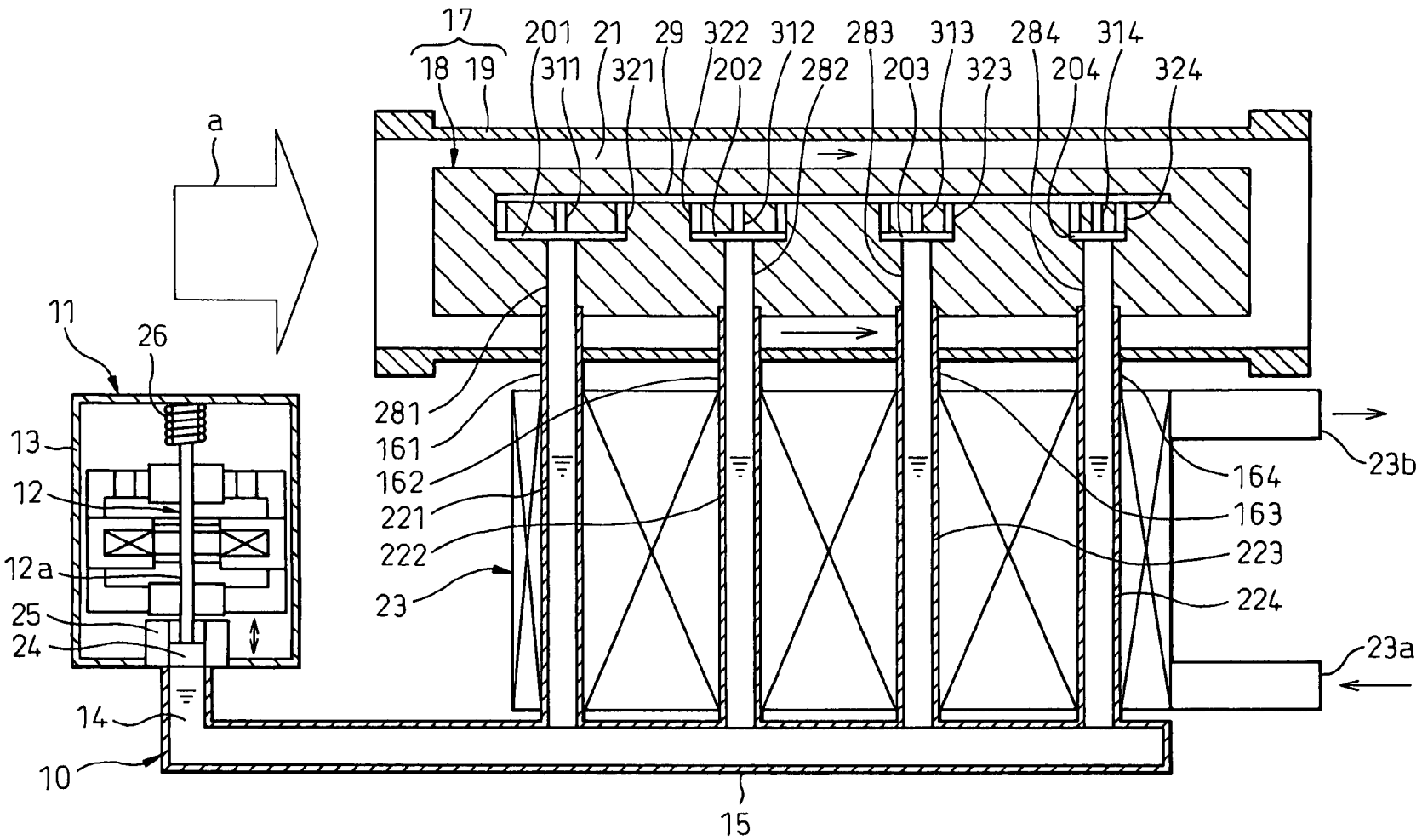
FIG. 6 is a diagram showing a general configuration of the power generating system according to a third embodiment of the invention.

More specifically, as shown in FIG. 6, the branch pipes located more upstream (leftward in FIG. 6) in the high-pressure gas among the four branch pipes 161 to 164 are rendered to branch from the portion of the collecting pipe 15 nearer the generator 11 (leftward in FIG. 6), while the branch pipes located more downstream (leftward in FIG. 6) in the high-pressure gas among the four branch pipes 161 to 164 are rendered to branch from the portion of the collecting pipe 15 farther from the generator 11 (rightward in FIG. 6).

Also, according to this embodiment, the diameters A1 to A4 of the inlets 271 to 274 of the evaporators 201 to 204 are equal to each other, and so are the diameters B1 to B4 of the central vapor paths 311 to 314, with the result that the areas S1 to S4 of the bombardment surfaces 331 to 334 are equal to each other.

In this configuration, the working medium paths leading to the evaporators located upstream of the evaporators have a shorter flow path length and a smaller flow resistance, while the working medium paths leading the evaporators located downstream of the generator 11 are longer in flow path length and larger in flow resistance.

As a result, the influent liquid amount of the working medium 14 increases progressively for the evaporators located more upstream, and decreases progressively for the evaporators located downstream. Therefore, similar effects to the first and second embodiments are achieved with a simpler configuration.

The areas S1 to S4 of the bombardment surfaces 331 to 334, though equal to each other in this embodiment, may of course be increased more for the evaporators located more upstream, and decreased more for the evaporators located more downstream as in the first and second embodiment.

Fourth Embodiment

Figure 7:
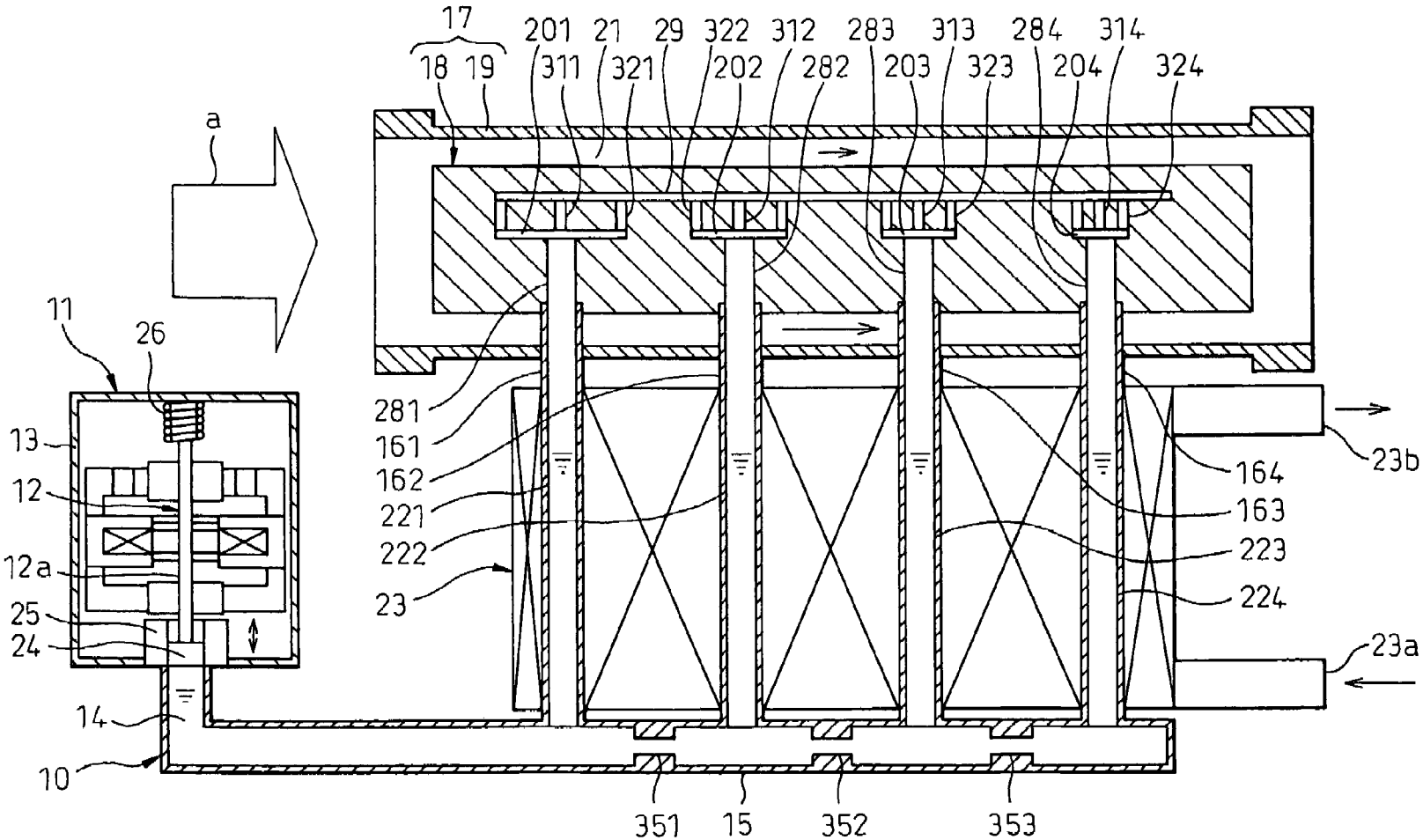
FIG. 7 is a diagram showing a general configuration of the power generating system according to a fourth embodiment of the invention.

According to the fourth embodiment, as shown in FIG. 7, unlike in the third embodiment, chokes 351 to 353 are formed in the collecting pipe 15.

More specifically, the chokes 351 to 353 are formed between the portions of the collecting pipe 15 from which the branch pipes 161 to 164 extend. Incidentally, the chokes 351 to 353 may be fixed ones such as orifices.

In this configuration, the flow resistance in each working medium path leading from the generator 11 to the evaporators 201 to 204 can be properly set by the chokes 351 to 353, and therefore, the influent liquid flow rate of the working medium 14 can be properly adjusted for each of the evaporators 201 to 204. As a result, heat loss is effectively reduced and efficiency of the external combustion engine effectively improved.

Other Embodiments (1) Unlike the embodiments described with the evaporators 201 to 204 formed in the shape of disk, the evaporators 201 to 204 may be formed in any of various other shapes such as a horizontal cylinder or a rectangular plate.

(2) Unlike the aforementioned embodiments in which the four branch pipes 161 to 164 extend from the collecting pipe 15, two or more arbitrary number of branch pipes may extend from the collecting pipe 15.

Also, unlike the aforementioned embodiments in which the branch pipes 161 to 164 are arranged only in the direction of flow of the high-temperature gas (rightward and leftward in FIGS. 1, 4 to 6), the branch pipes may alternatively be arranged in the direction perpendicular to the flow of the high-temperature gas (the direction perpendicular to the page in FIGS. 1, 4 to 6) as well as in the direction of the flow of the high-temperature gas. By doing so, the size increase of the external combustion engine can be suppressed while at the same time making it possible to increase the number of the branch pipes.

(3) Unlike the aforementioned embodiments using the high-temperature gas as a heat source of the evaporators 201 to 204, any of various other high-temperature fluids may be used for the same purpose.

Also, a heat generating member may be used as a heat source of the evaporators 201 to 204. In such a case, the heat generating member may be kept in contact with the block member 18 in a way adapted for heat transmission or arranged in proximity to the block member 18 at a predetermined distance therefrom.

(4) Unlike the aforementioned embodiments in which the invention is used for a drive source of a power generating system, the invention is not limited to such embodiments and applicable to other drive sources with equal effect.

While the invention has been described by reference to specific embodiments chosen for purposes of illustration, it should be apparent that numerous modifications could be made thereto by those skilled in the art without departing from the basic concept and scope of the invention.

The invention claimed is:

1. An external combustion engine comprising:

a container containing a working medium adapted to flow in liquid phase and including one collecting pipe and a multiplicity of branch pipes branching from the collecting pipe;

a multiplicity of evaporators communicating with the end of the multiplicity of the branch pipes far from the collecting pipe for heating and evaporating part of the working medium in liquid phase;

a multiplicity of condensers formed in at least a part of the multiplicity of the branch pipes for cooling and condensing the working medium evaporated in the evaporators; and an output unit communicating with the end of the collecting pipe far from the multiplicity of the branch pipes for converting the displacement of the liquid-phase portion of the working medium into mechanical energy and outputting the energy;

wherein the multiplicity of the evaporators are supplied with heat from a common heat source; and wherein a first process for displacing the liquid-phase portion of the working medium toward the output unit by evaporating the working medium in the multiplicity of the evaporators alternates with a second process for displacing the liquid-phase portion of the working medium toward the multiplicity of the evaporators by condensing the working medium evaporated in the first process in the multiplicity of the condensers;

the external combustion engine further comprising an influent liquid amount regulation means wherein the influent liquid amount, defined as the amount of the liquid-phase portion of the working medium flowing into any one of the multiplicity of the evaporators upon displacement of the liquid-phase portion of the working medium from the output unit toward the multiplicity of the evaporators in the second process, is so regulated that the influent liquid amount is larger for the evaporators nearer the heat source, and smaller for the evaporators farther from the heat source.

2. The external combustion engine according to claim 1, wherein a multiplicity of the evaporators include a multiplicity of inlets from which the liquid-phase portion of the working medium flows in, a multiplicity of wall surfaces in opposed relation to the inlets at predetermined intervals, and a multiplicity of main evaporators extending in the direction perpendicular to the direction of the opening of the inlets from a space between the inlets and the opposed wall surfaces, and wherein the influent liquid amount regulation means is configured so that the area of the opposed wall surfaces is larger for the evaporators nearer the heat source, and the area of the opposed wall surfaces is smaller for the evaporators farther from the heat source.

3. The external combustion engine according to claim 2, further comprising a vapor pool for storing the vapor of the working medium generated in the multiplicity of the evaporators, wherein the opposed wall surfaces of the multiplicity of the evaporators each have an open vapor path which communicates with the vapor pool and through which the vapor passes, and wherein the opening area of the vapor path is smaller for the evaporators nearer the heat source and larger for the evaporators farther from the heat source.

4. The external combustion engine according to claim 2, wherein the area of the inlets is larger for the evaporators nearer the heat source and smaller for the evaporators farther from the heat source.

5. The external combustion engine according to claim 1, wherein the influent liquid amount regulation means is so configured that the branch pipes communicating with the evaporators nearer the heat source extend from the portion of the collecting pipe nearer the output unit and the branch pipes communicating with the evaporators farther from the heat source extend from the portion of the collecting pipe farther from the output unit.

6. The external combustion engine according to claim 5, wherein a multiplicity of chokes for increasing the flow path resistance are formed between the portions of the collecting pipe from which the multiplicity of the branch pipes extend.

7. The external combustion engine according to claim 1, wherein the heat source is a high-temperature fluid, wherein the evaporators nearer the heat source are those of the multiplicity of the evaporators arranged more upstream in the high-temperature fluid, and wherein the evaporators farther from the heat source are those of the multiplicity of the evaporators arranged more downstream in the high-temperature fluid.

8. An external combustion engine comprising:

a container containing a working medium in liquid phase adapted to flow and including one collecting pipe and a plurality of branch pipes extending from the collecting pipe;

a plurality of evaporators communicating with the end of the plurality of the branch pipes far from the collecting pipe for heating and evaporating part of the working medium in liquid phase;

a plurality of condensers formed in at least a part of the plurality of the branch pipes for cooling and condensing the working medium evaporated in the evaporators; and an output unit communicating with the end of the collecting pipe far from the plurality of the branch pipes for converting the displacement of the liquid-phase portion of the working medium into mechanical energy and outputting the energy;

wherein the plurality of the evaporators are supplied with heat from a common heat source; and wherein a first process for displacing the liquid-phase portion of the working medium toward the output unit by evaporating the working medium in the plurality of the evaporators alternates with a second process for displacing the liquid-phase portion of the working medium toward the plurality of the evaporators by condensing the working medium evaporated in the first process in the plurality of the condensers;

the external combustion engine further comprising an influent liquid amount regulation means wherein the influent liquid amount, defined as the amount of the liquid-phase portion of the working medium flowing into any one of the plurality of the evaporators upon displacement of the liquid-phase portion of the working medium from the output unit toward the plurality of the evaporators in the second process, is so regulated that the influent liquid amount for those of the plurality of the evaporators nearer the heat source is larger than the influent liquid amount for those of the plurality of the evaporators farther from the heat source.

* * * * *